US006017292A

United States Patent [19]

Gift et al.

[11] Patent Number: 6,017,292

[45] Date of Patent: Jan. 25, 2000

[54] METHOD AND APPARATUS FOR ATTACHING A TRAMPOLINE PAD

[75] Inventors: J. Paul Gift; Tim Voss, both of Columbus, Miss.

[73] Assignee: Flexible Flyer, West Point, Miss.

[21] Appl. No.: 09/056,581

[22] Filed: Apr. 7, 1998

[51] Int. Cl.[7] ..... A63B 5/10

[52] U.S. Cl. ..... 482/27; 482/28

[58] Field of Search ..... 482/27–29; 182/139–140

[56] References Cited

U.S. PATENT DOCUMENTS

| | | | |
|---|---|---|---|
| 2,799,867 | 7/1957 | Fenner | 482/28 |
| 2,999,558 | 9/1961 | Bohrer, Sr. | 482/27 |
| 4,037,834 | 7/1977 | Oaks | 482/27 |

FOREIGN PATENT DOCUMENTS

| | | | |
|---|---|---|---|
| 0542455 | 5/1993 | European Pat. Off. | 482/27 |
| 2657528 | 8/1991 | France | 482/27 |
| 0280467 | 7/1990 | German Dem. Rep. | 482/27 |

*Primary Examiner*—Jerome Donnelly
*Attorney, Agent, or Firm*—Brinks Hofer Gilson & Lione

[57] ABSTRACT

A method and apparatus are provided for attaching a pad to a trampoline frame. A tab is attached to the pad and is wrapped radially inward around the frame and is secured to the frame in communication with the means used to secure the bouncing surface of the trampoline to the frame.

14 Claims, 1 Drawing Sheet

METHOD AND APPARATUS FOR ATTACHING A TRAMPOLINE PAD

BACKGROUND OF THE INVENTION

The present invention relates to trampolines, and more particularly to a method and apparatus for attaching trampoline safety pads to a trampoline frame.

Children and adults enjoy using trampolines for various exercises and recreation. During use a danger exists that the person on the trampoline may fall onto the frame or into the area between the bouncing surface and the trampoline frame. Federal consumer protection safety laws require trampolines to have some type of pad on the trampoline frame. Trampoline safety pads cover the trampoline frame and trampoline springs so as to satisfy these regulations and provide a safer trampoline.

Currently, ties, cords or straps are used to attach the safety pads to the trampoline frame. A common method of attaching the pad to the frame is the use of narrow straps or cords. These straps are wrapped around the frame, pass through an opening in the pad and are then tied off or secured on the outside surface of the pad.

The means currently employed to secure safety pads to the trampoline frame have several shortcomings. First, narrow ties wear out quickly because they are often not strong enough to withstand the substantial wear and tear of everyday use. Second, current ties are often secured on the outside of the pad. This location exposes the ties to abusive weather conditions and to curious children that may loosen the ties and create a hazardous condition. Third, current ties have a very small amount of surface contact with the frame. Consequently, the ties are able to slip and shift quite easily along the frame. This is undesirable because the pad may interfere with the bouncing surface. Fourth, the knots that are often used to secure these ties have a tendency to tighten with use and exposure, often requiring them to be cut off in order to remove the pads. Lastly, prior pad designs only covered the top portion of the frame and the narrow ties did little to create continuous contact between the pad and the frame. As a result, it was quite easy for wind or children to lift, tear and fatigue the pad through repeated abuse.

Consequently, a need exists for a pad that can be more securely and reliably attached to the trampoline frame.

SUMMARY OF THE INVENTION

A method for attaching a trampoline pad to a trampoline frame is provided wherein the pad comprises a tab that is wrapped radially inward around the frame and secured on the frame.

Similarly, a trampoline pad and apparatus for attaching the trampoline pad are provided in which a tab that is attached to the trampoline pad is wrapped radially inward around the frame and secured on the frame.

DETAILED DESCRIPTION OF THE DRAWINGS AND PREFERRED EMBODIMENTS OF THE INVENTION

A general description of a suitable trampoline is provided below in order to establish a context in which to understand the present invention. However, it should be noted that the method and apparatus of the present invention may be used with any trampoline, or other device, in which one must attach a pad to a frame. The applications in which the present invention may be used are not limited to the specified trampoline described below. It is preferred to use the present invention for attaching safety pads to the frame of a trampoline. However, this application is exemplary and preferred, but not limiting.

Figure 1:
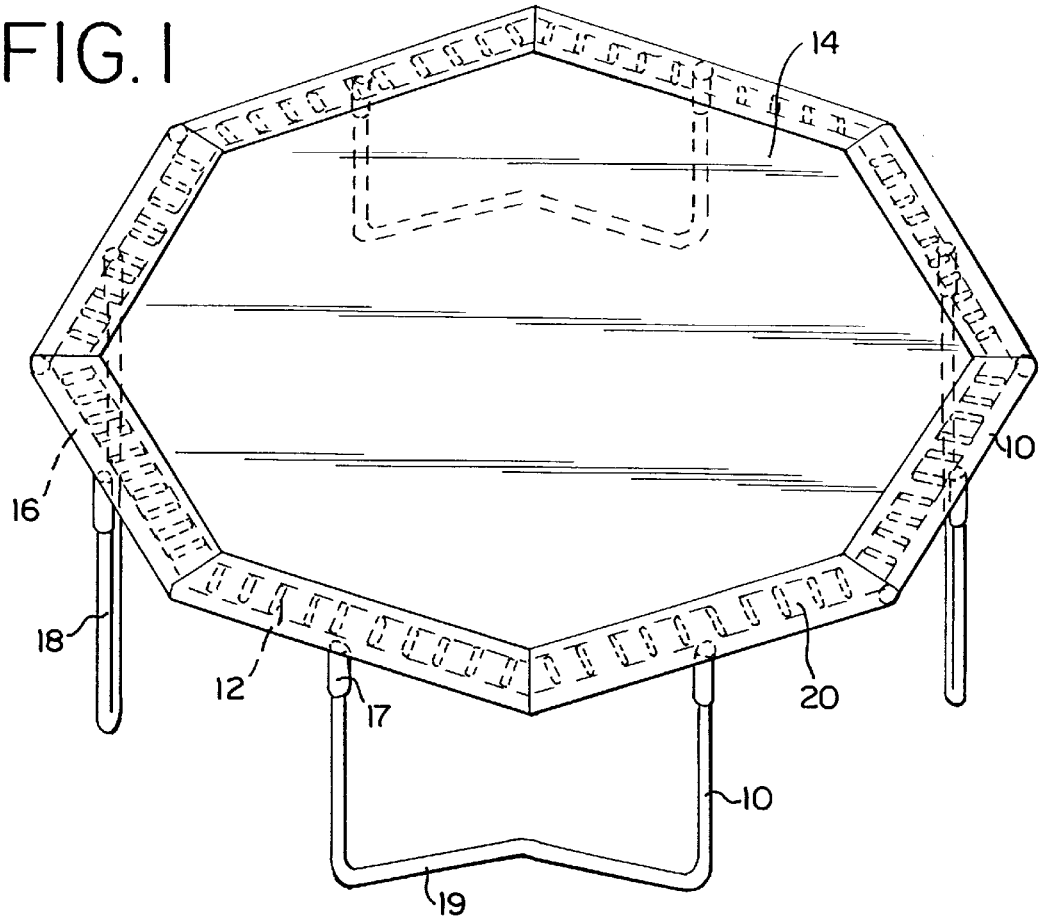
FIG. 1 is a perspective view of a conventional trampoline.
Figure 2:
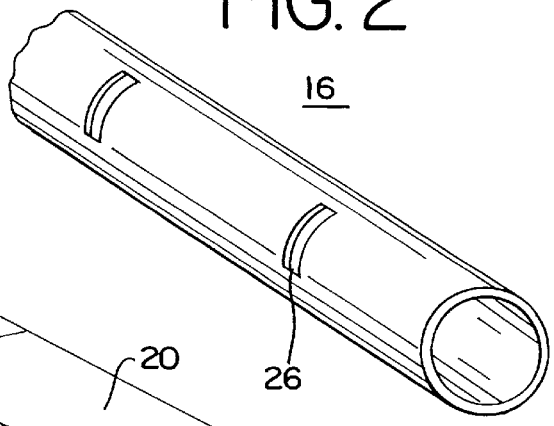
FIG. 2 is a perspective view of a horizontal frame member 16.

Generally, a trampoline, as shown in FIG. 1, consists of a frame 10, a bouncing surface 14 and springs 12. The frame 10 provides support for the bouncing surface 14, and is linked to the bouncing surface 14 via the trampoline springs 12. The frame 10, springs 12 and bouncing surface 14 are conventional, and described further herein only to the extent necessary to describe the invention.

The trampoline frame 10 has both horizontal frame members 16 and vertical frame members 18. In a preferred embodiment, these frame members are cylindrical steel tubes. The vertical frame members 18 form legs which are connected at their bottom to another leg by a cross piece 19. In a preferred embodiment, the horizontal frame members 16 are attached to one another using telescoped ends. The horizontal frame members include a leg joiner tube 17 welded onto their bottom. The leg 18 fits into the tube 17 to connect the leg 18 to the horizontal frame member. In FIG. 1, the horizontal frame members 16 are attached to form an octagon shaped trampoline frame 10. However, the trampoline frame members could be joined to form a variety of shapes including a hexagon, rectangle, circle and an ellipse. The legs 18 attach to the horizontal frame members 16 at a location central to each octagonal side of the trampoline.

In FIG. 1, the bouncing surface 14, like the frame 10, is octagonal in shape. Also, like the frame 10, the bouncing surface 14 can have a variety of shapes such as hexagonal. elliptical, rectangular or circular. The bouncing surface 14 provides an elasticized area for individuals to perform activities such as acrobatics, flips and various exercises. It is attached to and held by the trampoline frame 10 using trampoline springs 12. It is preferred to use trampoline springs 12; however, the bouncing surface 14 may be secured by any means capable of attaching the bouncing surface 14 to the frame 10 and creating a biased, resilient connection between the bouncing surface 14 and the frame 10. The trampoline springs 12 are attached at one end to the bouncing surface 14 and are attached at the other end to the frame 10. Preferably, the springs 12 are attached to the frame 10 by inserting the end of the spring 12 into a tube opening 26 in the horizontal frame member 16.

The bouncing surface 14 is disposed within the circumference of the frame 10 and the frame 10 may be said to be situated radially outward from the bouncing surface 14. With this frame of reference, in the following description movement towards the bouncing surface 14 is referred to as "radially inward" and movement away from the bouncing surface 14 is referred to as "radially outward."

As shown in FIG. 1, a number of trampoline safety pads 20 are attached to a trampoline frame 10. Each trampoline safety pad 20 partially or completely covers trampoline springs 12, which hold a bouncing surface 14 to the trampoline frame 10. The safety pad 20 may be comprised of a closed cell polyethylene foam and also may be comprised of alternative materials such as cross linked polyethylene, open celled polyurethane and rim molded polyurethane. Preferably the foam used to construct the pad 20 is high density foam.

A tab 30 secures the trampoline pad 20 to the frame 10. The tab 30 can be an integral part of the pad 20 or it may be an individual component that is attached to the pad 20. In a preferred embodiment, the tab 30 is an individual part that is sewn onto the pad 20. Preferably, tab 30 is constructed of a durable, high-strength material that is resistant to weather and repeated stresses. Examples of such materials are polypropylene or polyethylene weaves, plastics or webbing.

Figure 3:
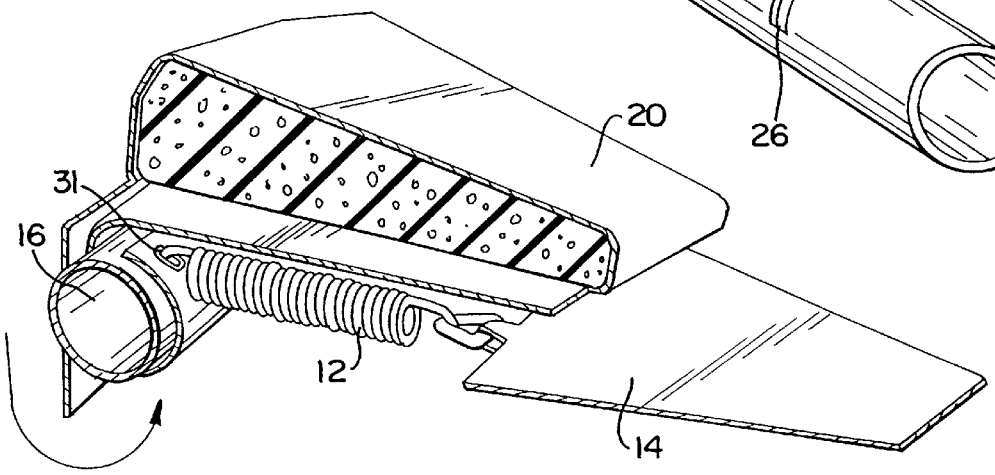
FIG. 3 is a perspective view of a method and apparatus in accordance with the present invention for attaching a pad to a trampoline frame.

The tab 30 contains tab holes 3 1. These tab holes 31 allow the trampoline springs 12 to hook into the horizontal frame member 16 through the tube openings 26. The tab holes 31 are located on the tab 30 such that when the pad 20 is disposed along a horizontal frame member 16, the tube openings 26 match the spring holes on the horizontal frame member 16. As shown in FIG. 3, one end of the spring 12 is hooked onto the bouncing surface 14 and the other end passes through the tab hole 31 and hooks onto the inside of the horizontal frame member 16 through the tube opening 26. This arrangement simultaneously secures the pad 20 and the bouncing surface 14 to the frame 10. While this arrangement is preferred, the springs 12 may also be secured to the frame 10 by alternative means. An example of such means is a hook that is attached to and extends from the horizontal frame member 16, penetrates through the tab hole 31 and secures the spring 12.

It is preferred for the tab 30 to be as wide as possible without being cumbersome to install or remove. The width of the tab 30 governs how much surface area contacts the frame 10. The greater the surface area that contacts the frame 10, the greater the frictional resistance to slipping and movement of the pad 20. In a preferred embodiment, the tab 30 is approximately seven inches wide. The width of the tab 30 also governs the strength of the connection between the tab 30 and the pad 20. A narrow tab will concentrate the forces between the pad 20 and the frame 10 on a smaller area and often results in the narrow tab tearing from the pad 20. A wider tab 30 will disperse and distribute the forces over a greater area so that no one area is over stressed and a strong pad-tab connection is maintained. It is preferred that tabs 30 are intermittently spaced approximately every 2–3 feet of pad 20. With respect to the trampoline shown in FIG. 1, this corresponds to approximately 2 tabs for each horizontal side.

The pad 20 is placed on the frame so as to cover the springs 12 and frame 10. Before the pad 30 is attached to the frame 10, the tab 30 extends radially outward from the pad 20 and the frame 10. To secure the pad 20 to the frame 10, the tab 30 is wrapped radially inward around the horizontal frame member 16. The rotation of the tab 30 is denoted by the arrow in FIG. 3. The horizontal frame member 16 will be used as an angular reference frame for sake of description. With respect to the horizontal frame member 16, 0-degrees is straight up, 90-degrees is radially outward and 270-degrees is radially inward. It is preferred that the tab 30 is rotated such that the tab hole 31 is located at a location greater than approximately 180-degrees. More preferably, the tab hole 31 is located at at least 270 degrees, and in the most preferred embodiment the tab hole 31 is located at approximately 300-degrees.

The method and apparatus of the present invention for securing the pad to the frame has two complementary advantages. First, by having the tab face radially inward, the connection between the pad and the frame is hidden under the pad and may not be reached without deliberate actions. As a result, curious children or unwary accidents will not cause the pad to become unattached from the frame. Second, removal and slippage of the pad is further hindered because the pad may not be moved without removing the spring from the frame. Because the spring also secures the bouncing surface, it is biased by the other springs and can only be removed through a firm and deliberate effort.

The following explains the method of attaching the trampoline safety pad 20 to a trampoline frame 10. The trampoline safety pad 20 is positioned to match the tab hole 31 with the tube opening 26 in the horizontal frame member 16. The springs 12 are then connected between the bouncing surface 14 and the frame members 16 by inserting the end of the springs 12 through the tab hole 31 and into the tube opening 26. The foregoing steps should be repeated until the entire trampoline frame member is covered by trampoline safety pads 20.

It should be understood that many changes and modifications can be made to the embodiments described above. It is therefore intended that the foregoing detailed description be understood as an illustration of the presently preferred embodiments of the invention, and not as a definition of the invention. It is only the following claims, including all equivalents, that are intended to define the scope of this invention.

What is claimed is:

1. A trampoline comprising a bouncing surface, a frame, a spring, a pad and an apparatus for securing the pad to the frame, the frame including a spring connector, the spring having a bouncing surface end and a frame end;

the apparatus for securing the pad to the frame comprising a tab having a first end, a second end and a tab hole, the first end being attached to the pad and the tab hole being disposed in the second end;

wherein the tab hole is aligned with the spring connector and the spring is inserted through the tab hole and secured to the spring connector.

2. The trampoline of claim 1 wherein the tab is wrapped circumferentially around the frame.

3. The trampoline of claim 1 wherein the second end of the tab is wrapped radially inward around the frame.

4. The trampoline of claim 1 wherein the second end of the tab is wrapped radially inward around the trampoline frame at least 270 degrees.

5. The trampoline of claim 1 wherein the spring connector comprises a hole in the frame and the spring is secured to the frame through said hole.

6. The trampoline safety pad of claim 1 wherein the pad and the bouncing surface are separate components.

7. The trampoline safety pad of claim 1 wherein the first end is detached from the bouncing surface.

8. A method for attaching a pad to a trampoline frame comprising:

a) providing a trampoline having a frame with a spring connector, a spring having a bouncing surface end and a frame end, a bouncing surface, and a pad;

b) providing a tab having a first end, a second end and a tab hole, the tab being attached to the pad at the first end and extending radially outward therefrom, the tab hole being disposed in the second end;

c) aligning the tab hole with the spring connector;

d) attaching the surface end of the spring to the bouncing surface and inserting the frame end of the spring through the tab hole; and e) securing the spring to the spring connector.

9. The method of claim 1 wherein the method further comprises the step of wrapping the second end of the tab radially inward around the trampoline frame.

10. The method of claim 1 wherein the method further comprises the step of wrapping the tab circumferentially around the trampoline frame.

11. The method of claim 1 wherein the method further comprises the step of wrapping the second end of the tab radially inward around the trampoline frame at least 270 degrees.

12. The method of claim 1 wherein the spring connector comprises a hole in the trampoline frame and the spring is secured to the trampoline frame through said hole.

13. The method of claim 1 wherein the pad and the bouncing surface are separate components.

14. The method of claim 1 wherein the first end of the pad is detached from the bouncing surface.

* * * * *